United States Patent [19]

Partington et al.

[11] Patent Number: 4,798,520

[45] Date of Patent: Jan. 17, 1989

[54] METHOD FOR INSTALLING INTEGRAL SHROUD TURBINE BLADING

[75] Inventors: Albert J. Partington, Winter Springs, Fla.; David A. Hornberger, Waxhow, N.C.

[73] Assignee: Westinghouse Electric Corp., Pittsburgh, Pa.

[21] Appl. No.: 53,246

[22] Filed: May 22, 1987

[51] Int. Cl.[4] ..... F01D 5/32

[52] U.S. Cl. ..... 416/219 R; 29/156.8 R; 403/12

[58] Field of Search ..... 416/219 R, 220 R, 248; 29/156.8 R, 156.8 CF; 403/12

[56] References Cited

U.S. PATENT DOCUMENTS

| | | | |
|---|---|---|---|
| 3,158,353 | 11/1964 | Reid et al. | 29/156.8 R |
| 3,627,448 | 12/1971 | Rupp | 416/219 R |

FOREIGN PATENT DOCUMENTS

| | | | |
|---|---|---|---|
| 221402 | 12/1984 | Japan | 416/220 R |
| 751740 | 7/1956 | United Kingdom | 416/220 R |
| 2115499 | 9/1983 | United Kingdom | 416/219 R |

*Primary Examiner*—Robert E. Garrett
*Assistant Examiner*—John T. Kwon

[57] ABSTRACT

Apparatus and method for installing an array of rotatable turbine blades each having an integral shroud segment. A removable blade anchor for installing the turbine blades comprises a root portion positionable in registry with a turbine rotor blade groove, a support member extending from the root portion for supporting a first of the blades to be installed and an anchor support extending from the support member and positionable against the rotor to secure the support member against circumferential forces. The installation method comprises the steps of positioning the removable blade anchor in a rotor groove and then wedging a plurality of blades in place about the rotor so that the integral shroud segment of each blade abuts an adjacent integral shroud segment and all shroud segments are forced against the blade anchor. Next, a first portion of the blades are rewedged in order to force the first portion of blades away from the blade anchor. The blade anchor is then removed without disturbing the tight abutment between the plurality of blades and additional blades are installed to complete the blade row.

10 Claims, 3 Drawing Sheets

METHOD FOR INSTALLING INTEGRAL SHROUD TURBINE BLADING

FIELD OF THE INVENTION

This invention relates in general to turbo-machinery and more particularly, to an improved apparatus and method for installing integral shroud blading in a steam turbine.

BACKGROUND OF THE INVENTION

In a turbomachine, such as a steam or gas turbine, a plurality of rotatable arrays of blades or foils are arranged in rows extending radially from an axially aligned rotor. The rows of blades react to the forces of a high pressure fluid flowing axially through the machine to produce rotation of the rotor and the blade rows. During operation the rotating blades experience centrifugal and vibrational forces which generate large stresses on the blade attachment structure and could affect blade integrity. In addition, the efficiency of work performed across each blade row is limited by the amount of fluid which flows between the blade tips and the turbine casing without contributing to blade rotation.

In order to minimize these mechanical and thermodynamic effects, the blade tips in each row are covered by a segmented shroud ring which forms a circumferential sealing surface for limiting stream leakage as well as providing the necessary constraint to control blade vibration and reduce stress levels at the base and root of each blade. To perform these functions the shroud segments should firmly abut one another so as to secure the blades in proper alignment during dynamic loading.

In the past, shroud rings have been attached to the blades by riveting each ring segment to one or more blade tips via tenons which are integrally formed with each blade. In order to strengthen the connection between the shroud and the blading, many blades are formed with integral shroud segments rather than tenons. FIGS. 2, 3 and 4 illustrate an integral shroud segment 11 formed on a typical side entry blade 13. Each shroud segment 11 has a leading planar edge 15 and a trailing planar edge 17 such that when adjoining blades are installed, as illustrated in the partial view of a blade row shown in FIG. 1, the leading shroud edge 15 of each blade abuts the trailing shroud edge 17 of an adjacent blade.

A prior method for installing rows of blade having integral shroud segments has required first wedging the Christmas tree shaped root 19 of an initial blade in registry with a first complementary steeple shaped groove 21 on the turbine rotor 23 to secure the blade portion 24 in radial alignment with the axis of rotation. The rotor 23 is then turned about its axis in order to sequentially install adjacent blades in one circumferential direction along the rotor. Typically, the initial and the subsequent blades have been installed from a fixed point, e.g., 60 degrees from the top-most position about the rotor. According to this method, after installing the initial blade and rotating it beyond the fixed point, a second blade is loosely shimmed in place from the bottom of a second rotor groove 21 adjacent the initial blade. With the leading edge 15 of the shroud segment on the second blade positioned against the trailing edge 17 of the shroud segment on the first blade, this prior method has relied on the gravitational weight of the second blade to create a compact fit between the shroud segments. The sequential installation of blades behind the second blade in this same manner has resulted in a relatively close fit between the shroud segments on additional blades. This installation process continued until the second to the last blade was positioned in its rotor groove. Next, a jack is installed in the one remaining opening in order to compress the shrouds of the installed blades against one another thus expanding the opening to receive a final closing blade in a tight fit to complete the blade row.

Blade installation methods which rely on the weight of a plurality of blades pressing against one another to create a tight fit between shroud segments may cause the initial wedged blade to move out of radial alignment. Although subsequent compression of the shroud segments with a jack prior to inserting the final blade can have the effect of realigning the blades, there is little control over such realignment. Furthermore, the effectiveness of such installation methods for creating a compact blade fit is inversely proportional to blade weight. Therefore, it is desirable to provide an improved installation method which assures proper blade alignment and which provides a sufficiently tight fit for lightweight blades.

SUMMARY OF THE INVENTION

It is an object of the present invention to provide an improved blade anchor for installing a row of turbine blades having integraly formed shroud segments and an improved method for installing a row of blades having integral shroud segments.

It is another object of the present invention to provide an adjustable blade anchor for radially aligning turbine blading about the rotor and for securing such blading in alignment during the blade installation process.

It is a further object of the invention to provide an improved method of installing a row of turbine blades which results in improved prestressing between shroud segments and which maintains necessary compression throughout the installation process to assure a tight blade fit until a final closing blade is installed to complete the blade row.

In a general form of the invention a removable blade anchor is provided for installing turbine blades having integrally formed shroud segments on a turbine rotor. The blade anchor comprises a root portion which is positionable in registry with a steeple shaped rotor groove, a blade support extending from the root portion for securing the alignment of a blade which is positionable in an adjacent rotor groove, an anchor support extending from the blade support and positionable against the rotor for securing the adjacent blade in radial alignment with respect to the turbine rotor and an adjustment means, positioned between the anchor support and the rotor, for radially aligning the blade support.

In one form of the invention the installation method generally comprises the steps of positioning a removable blade anchor which has an integral shroud in a first rotor groove and then wedging a plurality of turbine blades circumferentially about the rotor so that each shroud segment tightly abuts an adjacent shroud segment and all shroud segments are forced against the blade anchor. A first portion of the blades extending from the trailing edge of the blade anchor shroud are next rewedged in order to force integral shroud segments formed on the first portion of blades away from the blade anchor. The blade anchor is then removed without disturbing the tight abutment between the plurality of blades and additional blades are installed to form a complete row of blades.

BRIEF DESCRIPTION OF THE DRAWINGS

The objects and advantages of this invention will become more apparent from the following detailed description in conjunction with the accompanying drawings, in which.

DETAILED DESCRIPTION OF THE PREFERRED EMBODIMENT

Figure 1:
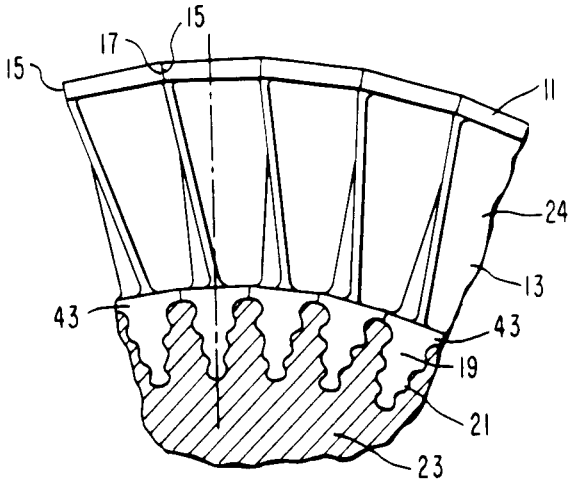
FIG. 1 is a partial sectional view of a rotatable blade row disposed about a turbine rotor.
Figure 2:
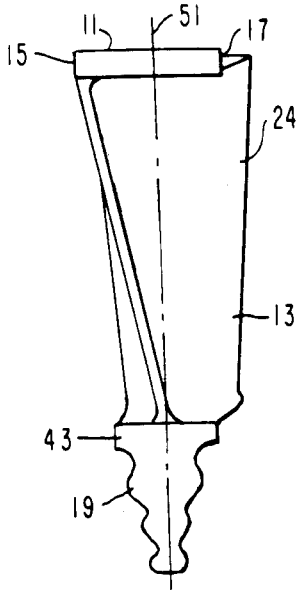
FIG. 2 is an axial view of a turbine blade having an integrally formed shroud segment.
Figure 3:
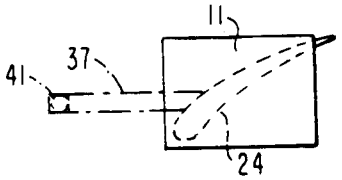
FIG. 3 is a radial view of the blade of FIG. 2.
Figure 4:
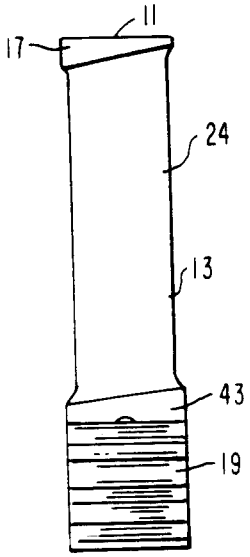
FIG. 4 is a tangential view of the blade illustrated in FIGS. 2 and 3.
Figure 5:
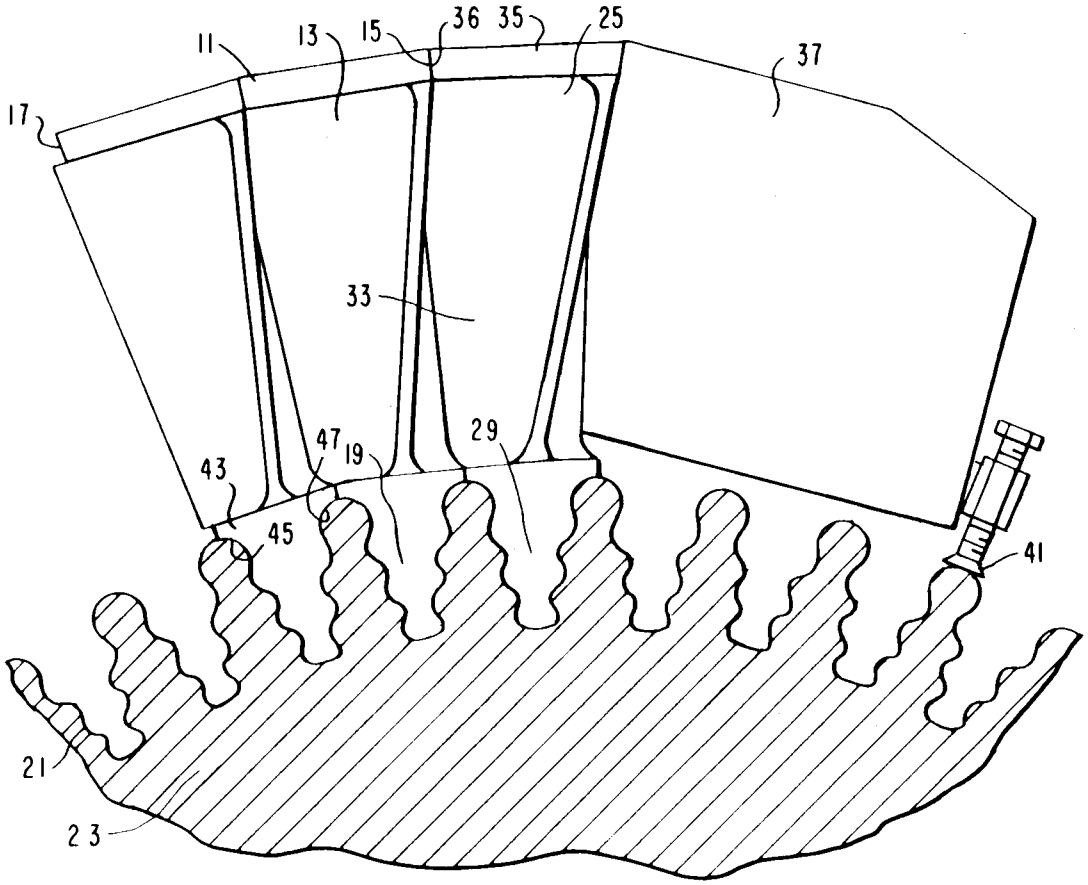
FIG. 5 is a partial sectional view of a turbine rotor having a blade anchor positioned in a rotor groove for installing a row of turbine blades having integrally formed shroud segments.

Referring now to FIG. 5 there is illustrated in one form of the invention a removable blade anchor 25 positionable on a turbine rotor 23 for installing a row of blades. In the preferred embodiment the blade anchor 25 resembles the integral shroud turbine blade 13 illustrated in FIGS. 2–4. The blade anchor 25 includes a root portion 29 positionable in registry with one of the steeple shaped rotor grooves 21 which are circumferentially disposed about the rotor 23. A blade portion 33 having attached to it an integral shroud segment 35 with a trailing edge 36 extends from the root portion 29. It is noted that in an alternate form of the invention, the blade portion 33 and the shroud segment 35 may be substituted with a shaft which is secured at one end to the root portion 29 and which has an opposite end portion positionable against the leading edge of an integral shroud segment on an adjoining blade 13. However, the blade portion 33 and shroud segment 35 are chosen in the preferred embodiment because an appropriately sized turbine blade having an integrally formed shroud segment may be easily modified to form the blade anchor 25.

An illustrated in FIG. 5, an anchor support plate 37 is attached, preferably by welding or brazing, to the blade portion 33 of the blade anchor 25. The support blade 37 extends circumferentially along the rotor 23 on the side opposite the trailing edge 36 of the integral shroud segment 35 of the blade anchor 25. The support plate 37 includes an adjustable swivel foot assembly 41 attached to an edge thereof opposite the blade portion 33 and adjacent the rotor 23. The swivel foot assembly 41 provides a means for exerting a force radially with respect to the rotor and tangentially with respect to shroud segments 11 in order to counter bending moments created about the root portion 29 by wedging of adjoining blades 13. By adjusting the swivel foot assembly 41 the blade member 33 and the shroud segment 35 may be radially aligned with the rotor 23. By way of example, the swivel foot 41 may comprise a screw mechanism in combination with a ball and socket (not illustrated). Advancement of the screw against the ball and socket will radially displace the ball and socket assembly to tension the support plate 37 away from the rotor 23 thus altering the radial alignment of the blade anchor 25.

The blade anchor 25 may be positioned on the rotor for installing turbine blades by first placing the root portion 29 in registry with a rotor groove 21. Next an initial blade 13 is installed in a groove 21 next to the anchor so that the leading edge 17 of the blade shroud segment 11 butts against the trailing edge 36 of the anchor shroud segment 35. In this arrangement the radial alignment of the initial blade 13 is controllable by varying the alignment of the blade anchor 25, i.e., by radially displacing the swivel foot assembly 41, precision alignment of the initial blade 13 is had with respect to the rotor 23. As a result, the anchor 25 is substantially in radial alignment with the rotor 23. The support plate 37 secures the blade anchor 25 in order to withstand bending moments about the root portion 29 while blades 13 are installed against the trailing edge 36 of the anchor's integral shroud segment 35. The blade anchor 25 will later be removed from the rotor 23 as discussed below.

Figure 6:
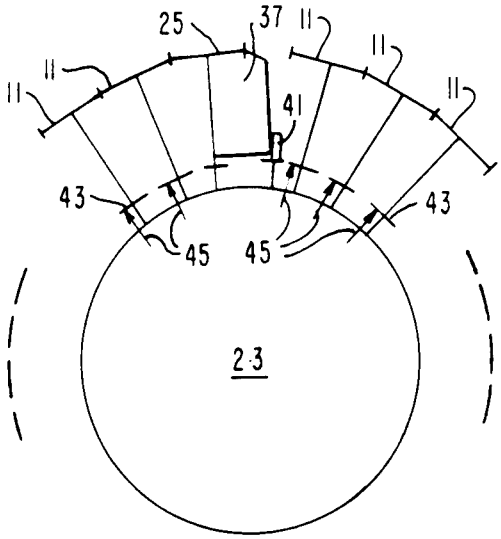
FIGS. 6, 7 and 8 are sectional views in schematic form of a turbine rotor illustrating the inventive method for installing a row of blades having integral shroud segments.
Figure 7:
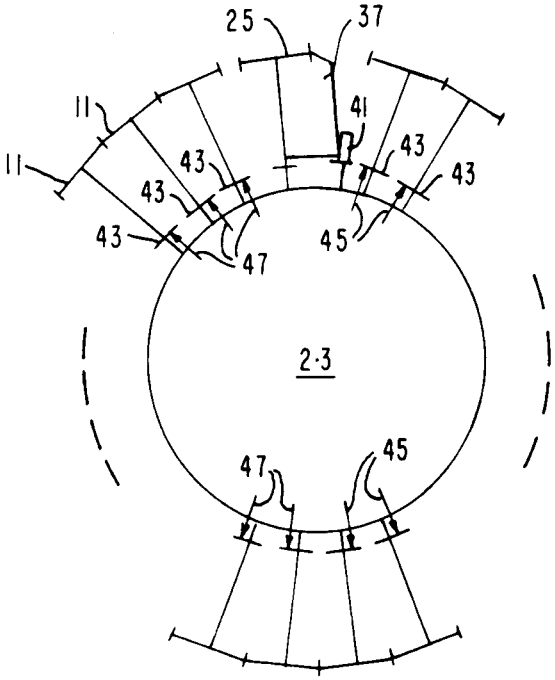
Figure 8:
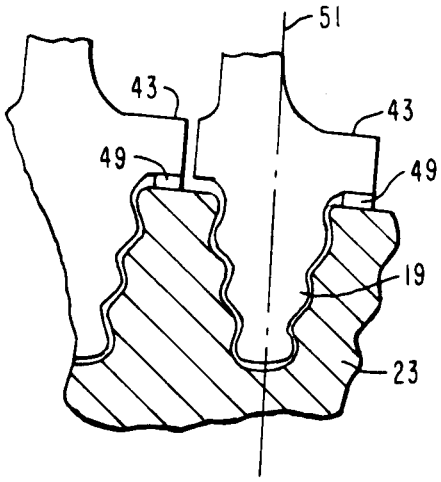
Figure 9:
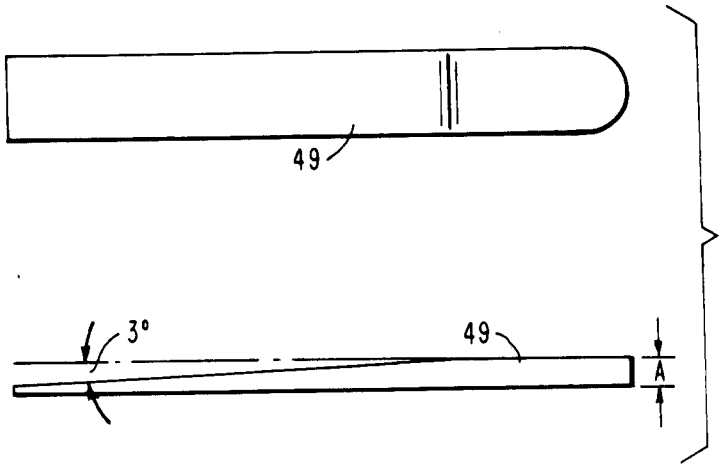
FIG. 9 is an illustration of a tapered wedge for installing blades.

FIGS. 5, 6 and 7 illustrate the inventive method for installing a row of turbine blades 13 on a rotor 23 having a plurality of circumferentially disposed steeple shaped blade grooves 21. The method comprises the initial steps of installing a removable blade anchor 25 in a first groove 21 and then installing a plurality of turbine blades circumferentially about the rotor 23. The blades are sequentially wedged in registry with a groove 21 so that the leading edge 15 of each shroud segment 11 tightly abuts the trailing edge 17 of the previously installed shroud segment 11, the installation beginning at the groove closest to the trailing edge 36 of the blade anchor shroud segment 35 and ending prior to the installation of a blade 13 in the remaining vacant groove 21 next to the blade anchor 25. The tight abutment between shroud segments 11 is achieved by placing a wedge 49 (see FIG. 8) between the platform 43 of each blade 11 and the rotor 23 at a position 45 (indicated by an arrow in FIG. 6) between a center line 51 of the blade root 19 and the trailing edge 17 of the integral shroud segment 11. Wedges 49 are typically hardened steel tapered shims such as that illustrated in FIG. 9 having a length of about 0.75 inch and a thickness (dimension A) of about 0.042 inch.

Next, according to the method and as illustrated in FIG. 7, a first portion, e.g., approximately one half, of the plurality of blades 13 which extend from the trailing edge 36 of the blade anchor 25 are rewedged to force shroud segments on the first portion of the blades 13 away from the blade anchor 25 while each shroud segment 11 remains in tight abutment with each adjacent shroud segment 11. The step is accomplished by sequentially moving each wedge associated with the first plurality of blades 13 from position 45 to a position 47 between the platform of a blade 11 and the rotor 23 and between the center of the associated blade root and the leading edge 15 of the integral shroud segment 11. As a result of rewedging, the trailing edge 17 of each shroud segment 11 in the first portion of blades 13 becomes forced against the leading edge 15 of an adjacent blade 13 in a direction away from the blade anchor 25. This allows the blade anchor 25 to be removed without disturbing the tight abutment between shroud segments 11. After removal of the blade anchor 25 additional blades 13 are installed to form a complete row of blades.

While the invention has been described for one form of turbine blades having integral shroud segments it will be appreciated by those skilled in the art to which the invention relates that broad application can be given to the novel blade anchor and method for installing turbine blades in many embodiments other than those described herein. Accordingly, many modifications in the apparatus and method illustrated herein may be made without departing from the spirit and scope of the invention as defined by the claims which follow.

What is claimed is:

1. A method of installing a row of blades on a turbine rotor with a blade anchor, each of the blades having a root portion, a blade portion extending from the root portion, a platform interposed between the root portion and the blade portion and an integrally fromed shroud segment extending from the blade portion, each shroud segment including a leading edge and a trailing edge, the blade anchor having a blade support member extending from a root portion and an end portion with a trailing surface positionable against the leading edge of a blade shroud segment, the rotor having a plurality of steeple shaped grooves circumferentially disposed about the rotor for receiving the root portion of the blades and the root portion of the blade anchor, said method comprising the steps of:

installing a removable blade anchor in a first groove;

installing a plurality of turbine blades circumferentially about the rotor by sequentially wedging each of the blades in registry with a corresponding one of the grooves so that each shroud segment tightly abuts an adjacent shroud segment and all shroud segments are forced toward the blade anchor, the installation beginning at a groove closest to the trailing surface of the blade anchor end portion and ending prior to the installation of a blade in the remaining vacant groove next to the anchor blade support;

rewedging a first portion of the plurality of blades extending from the trailing surface of the blade anchor end portion to force shroud segments on the first portion of blades away from the blade anchor while each shroud segment remains in tight abutment with each adjacent shroud segment so that the blade anchor may be removed without disturbing the tight abutment between shroud segments;

removing the anchor blade after rewedging the first portion of blades; and installing additional blades in the rotor to form a complete row of blades.

2. The method of claim 1 further comprising the step of substantially positioning the blade anchor in radial alignment with the rotor after a first of the plurality of blades is wedged in registry with a groove in order to radially align the first blade with respect to the rotor.

3. The method of claim 1 wherein the step of installing the plurality of blades about the rotor so that each shroud segment tightly abuts an adjacent shroud segment is accomplished by placing a wedge between each blade and the rotor at a position between the center of the root portion and the trailing edge of the integral shroud segment in order to abut the leading edge of the shroud segment on the blade being installed against the trailing edge of the shroud segment on the preceding blade in the installation sequence.

4. The method of claim 3 wherein the step of installing the plurality of blades about the rotor is accomplished by placing the wedges between the blade platforms and the rotor.

5. The method of claim 3 wherein the step of rewedging the first portion of blades is accomplished by moving each wedge associated with the first portion of blades to a blade position between the center of the root portion and the leading edge of the shroud segment on each blade so that the trailing edge of each shroud segment in the first portion of blades becomes forced against the leading edge of an adjacent blade in a direction away from the blade anchor.

6. The method of claim 5 wherein the step of rewedging the first portion of blades is accomplished by moving each wedge associated with the first portion of blades to a blade position between the blade platform and the rotor as well as between the center of the root portion and the leading edge of the integral shroud segment.

7. The method of claim 1 wherein the first portion of blades comprises approximately one half of the plurality of blades.

8. The method of claim 1 wherein the blade anchor further comprises an anchor support securable against the rotor by means of an adjustable swivel foot assembly for radially aligning the blade anchor with respect to the rotor, the method further comprising the step of positioning the blade anchor substantially in radial alignment with respect to the rotor.

9. The method of claim 8 wherein the step of aligning the blade anchor is performed by adjusting the swivel foot assembly until the blade in the groove closest to the leading surface of the blade anchor end portion is in radial alignment with respect to the rotor.

10. A removable blade anchor for installing a turbine blade having an integrally formed shroud segment in one of a plurality of steeple shaped grooves which are circumferentially disposed about a turbine rotor, said blade anchor comprising:

a root portion positionable in registry with a steeple shaped groove;

means extending from the root portion for supporting a blade which is positionable in an adjacent groove;

an anchor support attached to said support means, extending from said support means and positionable against the rotor, for securing said support means against circumferential forces when supporting a blade in the adjacent groove; and means interposed between said support means and the rotor for adjusting the radial alignment of said support means with respect to the rotor.

* * * * *